US009604103B2

(12) United States Patent
Browning et al.

(10) Patent No.: US 9,604,103 B2
(45) **Date of Patent: *Mar. 28, 2017**

(54) MONOFIN, TAIL AND METHOD

(71) Applicant: BLUE SPRING PARTNERS, LLC, Rigby, ID (US)

(72) Inventors: Eric Browning, Shelley, ID (US); Steven Browning, Rigby, ID (US); Brent Houghton, Shelley, ID (US); Kyle Kinghorn, Rexburg, ID (US); Christine Dustin, Idaho Falls, ID (US)

(73) Assignee: Blue Spring Partners, LLC, Idaho Falls, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/854,601

(22) Filed: Sep. 15, 2015

(65) Prior Publication Data

US 2016/0051860 A1 Feb. 25, 2016

Related U.S. Application Data

(63) Continuation-in-part of application No. 14/286,735, filed on May 23, 2014, now Pat. No. 9,162,110.

(51) Int. Cl.
*A63B 31/11* (2006.01)
*A63B 31/12* (2006.01)

(52) U.S. Cl.
CPC ..... *A63B 31/11* (2013.01); *A63B 31/12* (2013.01); *A63B 2209/00* (2013.01); *A63B 2209/10* (2013.01); *A63B 2210/50* (2013.01)

(58) Field of Classification Search
CPC ..... A63B 31/00; A63B 31/08; A63B 31/10; A63B 31/11
USPC ..... 441/64
See application file for complete search history.

(56) References Cited

U.S. PATENT DOCUMENTS

| | | | | |
|---|---|---|---|---|
| 3,344,449 | A | 10/1967 | Grilli | |
| 3,934,290 | A | 1/1976 | Le Vasseur | |
| 4,541,810 | A * | 9/1985 | Wenzel | A63B 31/11 441/64 |
| 4,781,637 | A | 11/1988 | Caires | |
| 5,429,536 | A | 7/1995 | Evans | |
| 6,086,440 | A | 7/2000 | Fechtner | |
| 6,375,530 | B1 | 4/2002 | Earl | |

(Continued)

FOREIGN PATENT DOCUMENTS

| | | | |
|---|---|---|---|
| JP | 4314461 | A | 11/1992 |
| WO | 9211176 | A1 | 7/1992 |
| WO | 2015178973 | A1 | 11/2015 |

OTHER PUBLICATIONS

Wikipedia; https://en.wikipedia.org/wiki/Monofin; Monofin; May 5, 2016.

(Continued)

*Primary Examiner* — Lars A Olson

(57) ABSTRACT

A monofin, mermaid tail, and method of applying the tail and monofin. The fin utilizes a core made of flexible yet resilient material such as plastic and a cover that is elastic, such as neoprene. The user's feet are connected to the fin by releasable connections including a securing cord and cord lock. The mermaid tail and monofin connects both of a user's feet and legs in order to facilitate swimming in a mermaid-like motion while giving the user the appearance of a mermaid.

76 Claims, 6 Drawing Sheets

(56) References Cited

U.S. PATENT DOCUMENTS

| | | | | |
|---|---|---|---|---|
| 6,764,362 | B1 * | 7/2004 | Wenzel | A63B 31/11 441/64 |
| 8,382,542 | B2 | 2/2013 | Pakhomov | |
| D679,480 | S | 4/2013 | Geurts | |
| 8,628,365 | B2 | 1/2014 | Burdick et al. | |
| 8,632,372 | B2 | 1/2014 | Fleck | |
| 8,986,170 | B2 | 3/2015 | Sherstnev et al. | |
| 9,162,110 | B1 * | 10/2015 | Browning | A63B 31/11 |
| 2011/0217890 | A1 | 9/2011 | Fleck | |
| 2011/0250818 | A1 | 10/2011 | Geurts | |
| 2012/0252289 | A1 | 10/2012 | Johnson | |

OTHER PUBLICATIONS

Magictail: http://www.magictail.de/index.php?option=com_sebercart&view=store&ck=208,It; design: copyright meerjungfrauenschwanzflosse 2011-2016.
Magictail—a real mermaid tail for swimming!—YouTube: https://www.youtube.com/watch?v=toWbMm6t5KI; uploaded Jul. 7, 2011.
Magictail—Magic Tail Review: YouTube: https://www.youtube.com/watch?v=QJapK1mCq0c; Published Mar. 30, 2013; Samantha fives-rush.
Mermaid Tail Review: https://www.youtube.com/watch?v=19dW8JFgurw; Published Jul. 30, 2013, MermaidTallTale.
Magical Mermaids—Making Dreams Come True: http://magicalmermaids.co.za/product/pro-mono-neoprene-replacement/; Pro Mono Neoprene Replacement; downloaded May 16, 2016.
Nov. 20, 2015 Letter from Fitzpatrick to Shaver and Swanson—Response to letter dated Nov. 18, 2015: The2Tails;—Fin Fin Mermaid; MONOFIN; Tail and Method.
Jan. 29, 2016 Letter from Miller to Swanson—Alleged Infringement of U.S. Pat. No. 9,162,110.
Feb. 29, 2016 Letter from Miller to Dowler—*Blue Spring Partners, LLC* v. *Sun Tail Mermaid LLC*, Rule 408 Communication.
Mar. 17, 2016 Letter from Fitzpatrick PC to Dowler—Response to letter dated Feb. 24, 2016; The2Tails—Blue Springs Partners, LLC MONOFIN, Tail and Method.
Mermaid Tails: website: www.mermaidtails.net.
Aqua Tails: website: www.aquatails.com.
Mermagica: website: www.mermagica.com.
Metro Swim Shop website: www.metroswimshop.com/product.Finis%20Wave.htm#.UocNqtJOWcw.
Miami Beach Mermaids website: http://miamibeachmermaids.com/#lmermaid-store/c1sn6.
The Mertailor website: https://www.themertailor.com/mermaid-monofin-flipper?search=flipper.
Lumugdano, Abigael T. "Explore the mythical world of fitness through mermaid swimming" Health & Fitness, Apr. 13, 2014.
Monofin, website: monofin.org/monofin-beginner.htm.
Mermaid Fin website: http://www.mermaidfin.com/.
Fin Fun Mermaid—How to use a Fin Fun Monofin. YouTube. Feb. 15, 2014 [retrieved on Apr. 14, 2015]. Retrieved from Internet: <Url:https://www.youtube.com/watch?v=TnJO7ch37js>, entire video.
Australian Government: IP Australia—Innovation Patent Examination Report No. 1. Patent Application No. 2015100165, Blue Spring Partners LLC Apr. 16, 2015.
PCT International Search Report and Written Opinion, PCT/US2015/015565, Blue Spring Partners, LLC, May 18, 2015.
Fin Fun Mermaid, All about our Mermail Monofins, Jun. 18, 2013.
Mermaid tail swimming apparatus sold by Magictail GmbH (photos).

* cited by examiner

MONOFIN, TAIL AND METHOD

TECHNICAL FIELD

The presently disclosed and claimed inventive concepts generally relate to an apparatus for swimming, and more particularly to a monofin and mermaid tail.

BACKGROUND

Swimming is a popular activity among millions of people every year. It is not uncommon to see a swimmer keep their feet together and swim in a style similar to a mermaid or a dolphin. This provides a different exercise as well as additional enjoyment for the swimmer.

In order to improve the ability of a swimmer to mimic a mermaid while swimming several monofins have been developed which increase the propulsion force of a user's feet while swimming in the mermaid style. A monofin keeps both of a user's feet connected to a single fin while having a large flat surface extending away from the user's feet. To secure the monofin to the user's feet, heel straps have been utilized. The heel straps, however, have a tendency to slide off of the user's heel once they are wet and the user places force on them during use. The monofins and heel straps have generally been constructed out of rubber or hard plastic.

Both of these construction practices result in a monofin that is uncomfortable to a user due to the abrasive nature of rubber or plastic that contacts a user's skin. It is desirable to produce a monofin that is more comfortable for a user. Unfortunately, in order to achieve the desired comfort it has been necessary to use materials that are not as hard or stiff as the rubber or hard plastic used to connect the user's feet to the monofin. This causes a significant loss in efficiency of the swimming stroke and enjoyment for the user. It is also desirable to allow users to have the appearance of a mermaid. While this appearance has been done before, the prior art has been limited to mainly performance driven design, with poor comfort features.

SUMMARY

Disclosed is a swimming device in the shape of a monofin similar to a mermaid fin that allows a user's feet to function similar to a mermaid tail or dolphin tail fin. The shape of the device is created by a resilient member that is flat and elongate, has a first side, second side, third side and fourth side, and first end and a second end. The sides are preferably curved and the second end is preferably concave in order to mimic the appearance of the trailing edge of a mermaid tail fin. The first end is the general location of the foot retainers.

The resilient member is enclosed by a cover. In a preferred embodiment, the cover is made from neoprene and the resilient member is made from polycarbonate, but other materials are acceptable. For example, the cover could be made of spandex or other elastic material while the resilient member may be made of a different plastic or rubber. The cover has a first edge, second edge, third edge and fourth edge that when placed around the resilient member, the edges of the cover are adjacent to the sides of the resilient member. The sides of the cover combine to make a periphery that extends around the resilient member in order to substantially enclose it. The cover can substantially enclose or surround the resilient member in the sense that a rubber band on a tennis ball substantially surrounds the tennis ball. Some portions of the resilient member can stick out from the cover. The cover can be held in place using various methods including adhesive or hook and loop closures, with stitching around the periphery being a preferred embodiment.

Attached to the cover are one or more foot retainers. These retainers secure the device to the user's feet in order to allow a user to swim in a motion similar to a mermaid without the swimming device coming off. The foot retainer can be made using one or more straps to secure the user's feet to the monofin. In a preferred embodiment the foot retainer is comprised of sock-like retainers extending underneath the top half of the cover. The sock-like retainers are elastic, allowing for a snug and secure fit with a variety of foot sizes. One or more securing cords are present, with one being located between the position of the user's feet. The securing cord is attached to the resilient member, and has a sliding lock which can be pressed toward the top surface of the resilient member to press and hold the cover against the resilient member. This provides a more secure foot retention ability. More than one securing cords are possible, with other sides being on the outside of where the user's feet are placed. More than one securing cord can be placed between the user's feet.

The securing cord can be attached to the resilient member in a number of different ways. The securing cord can pass through the resilient member and be secured by a plate on the underside of the resilient member, the backup plate can be embedded inside the resilient member, or attached to the resilient member with a bold and eyebolt, or an equivalent structure.

Further disclosed is a method for applying a mermaid tail. A first step is placing a tubular fabric mermaid tail, having a waist section, a leg section, and a tail section, around a user's legs. The second step is for the waist section of the mermaid tail to be placed around the user's waist. The third step is pulling the tail section above a user's feet, exposing the user's feet. The fourth step is placing a swimming device, a monofin, on the user's feet. The monofin is designed to create a single fin whereon each of a user's feet is attached. The fifth step is to tighten the securing cord described above to more positively secure the users feet to the monofin. The sixth step is to pull the tail section down over the monofin, covering the monofin to create the appearance of a continuous fin and tail.

The disclosed design is preferable over monofin designs presently available because of its increased comfort in attachment of the monofin to the user's feet, due to eliminating rubbing or pinch points. It has increased ease of use due to having no buckles or straps or other cumbersome attachment means, and the resilient member results in increased flexibility and realistic movement of the fin in the water. The stretchy nature of the foot pockets allows for use by a wide range of foot sizes, the feet being held securely in the monofin while swimming and easy release of the feet from the mono fin when the user wishes to remove the monofin. By being light weight (it is virtually weightless yet is not too buoyant to hinder swimming beneath the surface).

DETAILED DESCRIPTION OF THE EXEMPLARY EMBODIMENTS

Figure 1:
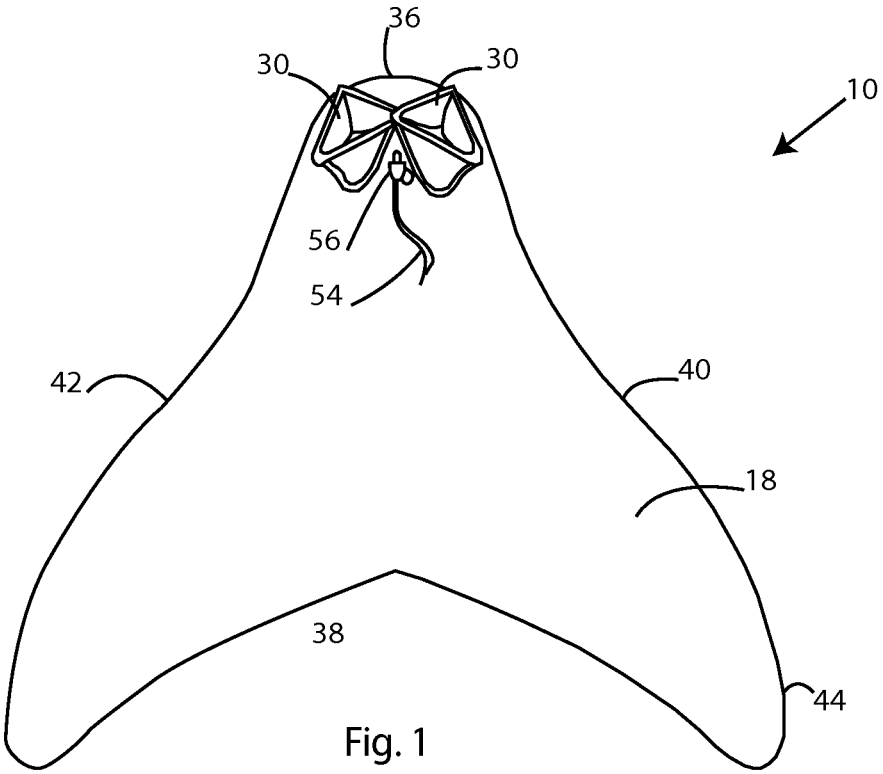
FIG. 1 is a top view of a monofin in accordance with an embodiment of the inventive concepts.

FIG. 1 shows a top view of swimming device 10. Swimming device 10 includes a cover 18 having a cover first edge 36, a cover second edge 38, a cover third edge 40 and a cover fourth edge 42. Combined these four edges form the periphery 44 of the cover 18. Swimming device 10 is attachable to a user's feet using foot retainers 30. FIG. 1 shows foot retainer 30 as two separate holes that pass into the swimming device 10 in order to secure both user's feet therein. Foot retainer 30 is made of two separate sock-like structures. Each sock-like structure extends into cover 18. Further, foot retainer 30 is made of an elastic material preferably a four-way stretch polyester and nylon blend, but other materials would also work such as spandex and nylon blend or neoprene, that allows for a snug fit with a wide range of foot sizes. The elastic material also allows for easy removal of swimming device 10. A user simply has to slide a finger or thumb down the heel behind the foot and the heel will come free from the foot retainer 30. In a preferred embodiment the foot retainers 30 extend into cover 18 but do not pass through flexible member 12, which is not shown in FIG. 1. While the system shown is preferred, other foot retainers are foreseeable including added straps and laces.

FIG. 1 shows swimming device 10 having the cover first edge 36, cover second edge 38, cover third 40 edge and cover fourth edge 42 curved in order to mimic a mermaid or dolphin fin. While this embodiment is preferred, it is possible to have the edges straight or curved in other shapes or a combination of straight and curved edges. In order to maintain shape and provide rigidity to the swimming device 10, a resilient member 12, which is not shown in FIG. 1, is positioned inside of cover 18. The preferred material for the swimming device 10 is neoprene because neoprene is soft, meant for use in water, and not very absorbent, but additional materials including spandex and polyester could be used. The size of the swimming device 10 can vary widely based on personal performance and aesthetics, but a general circumference of 76 inches works well for adults with a circumference of 62 inches being preferred for many children. A size for children and a size for adults is preferred, with the child size 40% smaller than the size for adults.

Figure 11:
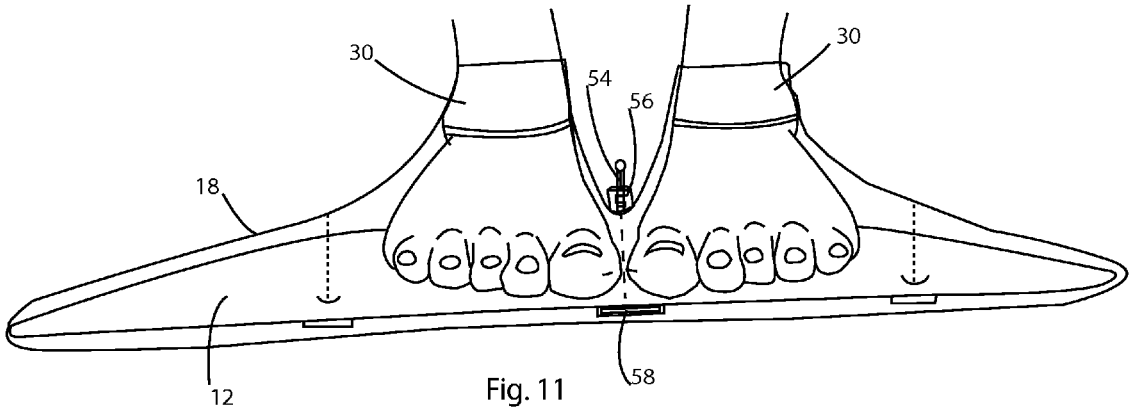
FIG. 11 is a front view of the mermaid tail showing the position of a user's feet and securing cords.

FIG. 1 shows the securing cord 54 and a cord lock 56. In this version the cord 54 extends through the resilient member 12 and is secured by an anchor 58, which can be a flat dish shape, and serves the purpose of securing one end of the cord 54 to the resilient member. The securing cord 54, the cord lock 56, and the anchor 58 are shown in more detail in FIG. 11. Shown in FIG. 11 are alternate positions of additional securing cords. A preferred locking cord is the Sporti Bungee Cord with a cord lock, and similar cords and locks would also work. A preferred position for placing at least one securing cord and lock is between the balls of the users feet.

The cover may expose the tips of the resilient member, to eliminate wear on the tips of the cover, or the tips of the cover may be covered with an additional layer of wear resistant material. The cover or the wear surfaces of the cover may also be made of a more wear resistant material than neoprene, such as nylon, Kevlar, canvas, hypalon, pvc, or other strong and wear resistant materials.

One configuration is to have three securing cords but only one tightening lock. The cord could be attached to the neoprene cover on the outside of the foot and then run through the resilient member, then underneath and across to the middle of the member, and finally up through a hole and through the cover between the feet. A second cord would do the same thing on the other side. Both cords would pull through a single tightening lock. This way, with a single pull, a user can draw the cords tight and secure the neoprene from the left, center, and right positions.

Figure 2:
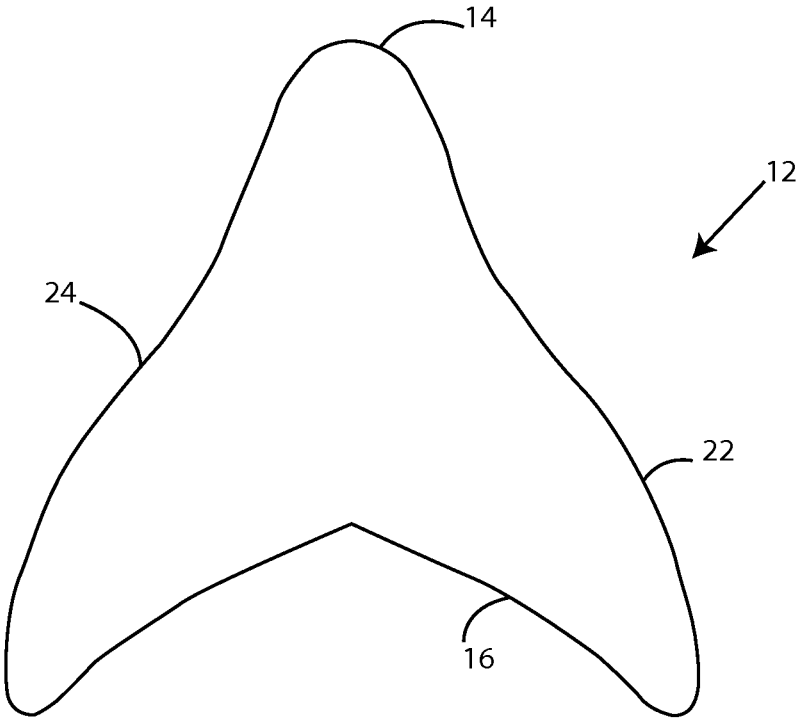
FIG. 2 is a top view of a resilient member in accordance with an embodiment of the inventive concepts.

FIG. 2 shows resilient member 12 prior to being placed within cover 18. As shown it is preferable for resilient member 12 and cover 18 to have similar shapes and sizes. However, modifications are possible in order to achieve various aesthetic and performance goals. Further, various thicknesses and materials can be used to obtain different stiffness. For example, making resilient member 12 thin and flexible will allow for easier movement in the water while making resilient member 12 thicker and less flexible will allow a stronger user to generate more propulsion force. The resilient member 12 is preferably removable from within cover 18. The ability to remove resilient member 12 allows the user to change resilient members for different users without the need to buy an entirely new swimming device 10. For instance, a stronger swimmer would be able to use a less flexible version of resilient member 12 while a weaker swimmer could switch in a more flexible version of resilient member 12. This also allows the swimming device 10 to be changed as a user improves their strength. In a preferred embodiment the resilient member 12 is 0.08 inches thick and made from polycarbonate. Other materials are possible such as other plastics, rubber, foam, or wood with different dimensions possible for each material. The preferred combination of a resilient member 12 made of polycarbonate and cover 18 made of neoprene yield results where the swimming device 10 is lightweight and feels nearly weightless in the water. The resilient member 12 is approximately neutral in buoyancy.

Shown in FIG. 2, resilient member 12 has a first side 14 located where a user's feet will be during use. Resilient member 12 further includes a second side 16 which operates to provide propulsion during use. Third side 22 and fourth side 24 of resilient member 12 are curved in order to improve performance as well as to mimic the shape of a Mermaid or Dolphin tail fin. Cover second edge 38 corresponds to resilient member second side while cover third edge 40 and cover fourth edge 42 correspond to resilient member third side and resilient member fourth side, respectfully.

Figure 3:
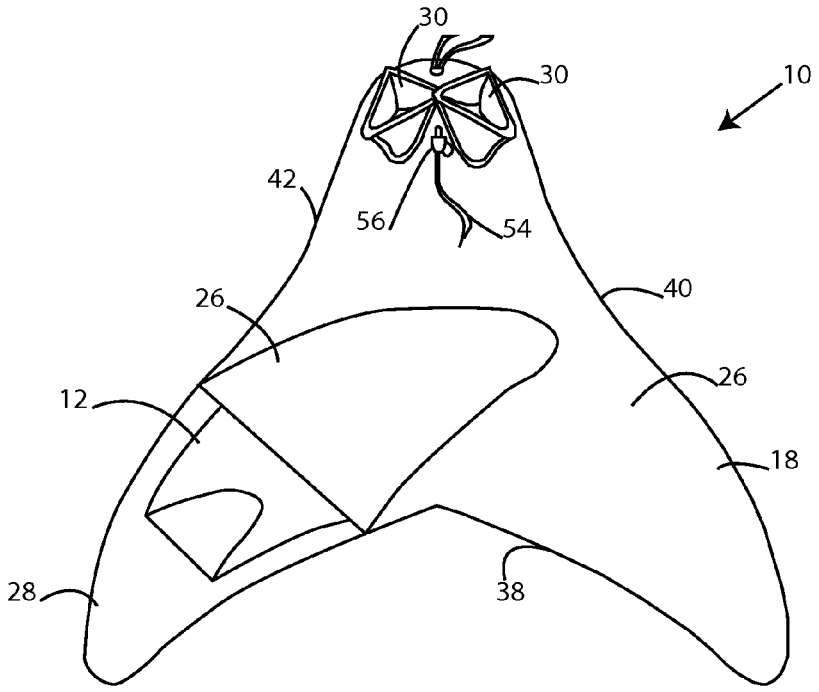
FIG. 3 is a top view of a monofin in accordance with an embodiment of the inventive concepts wherein the cover is folded open to show the interior resilient member.

FIG. 3 shows the resilient member 12 located between a cover top half 26 and cover bottom half 28. The cover top half 26 has been partially folded back to show resilient member 12, which is also partially folded back. Once cover top half 26 and cover bottom half 28 are secured, this configuration prevents resilient member 12 from separating from the cover 18 while providing rigidity to the swimming device 10.

Figure 4:
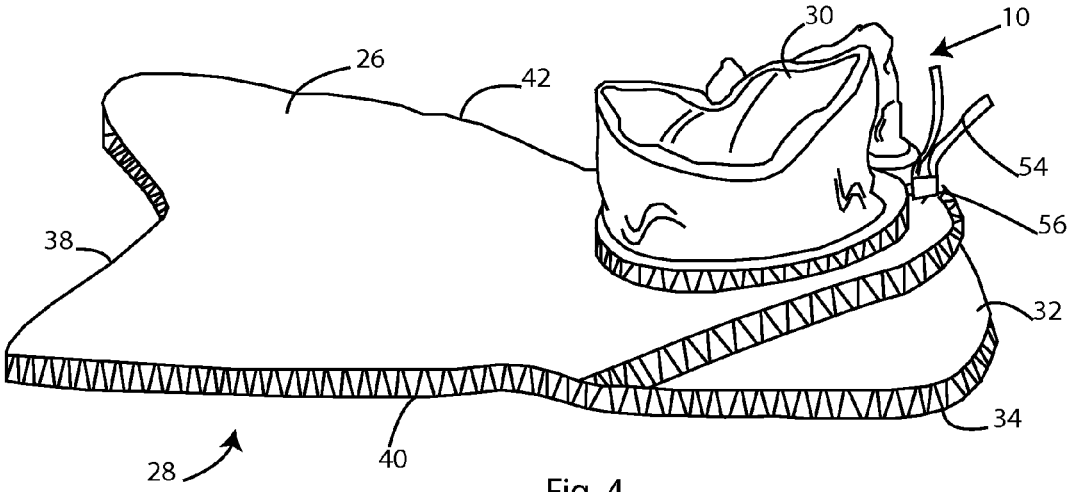
FIG. 4 is a perspective view of the rear of a monofin in accordance with an embodiment of the inventive concepts.

FIG. 4 shows cover first edge 36 having a rear side 32. Rear side 32 provides room for a user's heel so that the user's feet can be positioned in between cover top half 26 and resilient member 12 while the user's heel is secured by the rear side 32. Also shown in FIG. 4 is a preferred design of securing cover top half 26 and cover bottom half 28 around resilient member 12. The design shown utilizes stitching 34 around the periphery 44 of the cover 18 in order to attach the cover top half 26 and cover bottom half 28 around resilient member 12. Other possibilities for securing the cover 18 around the resilient member 12 include the use of adhesives, the use of lacing, hook and loop fasteners, buttons, a combination thereof or other mechanisms.

Figure 5:
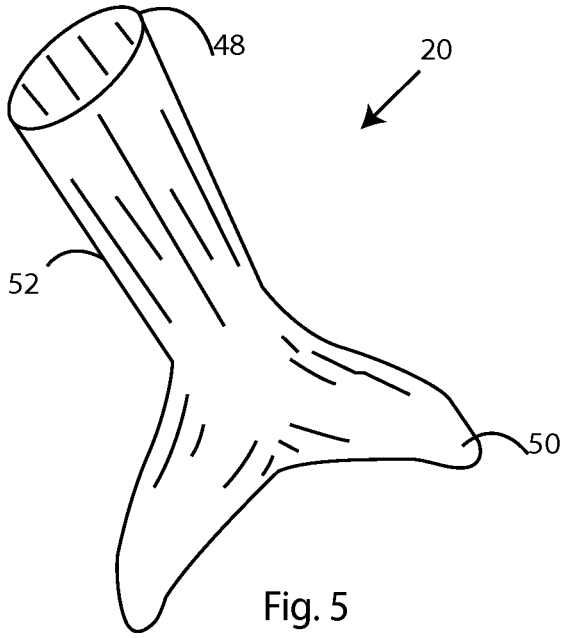
FIG. 5 is a perspective view of a mermaid tail in accordance with an embodiment of the inventive concepts.

FIG. 5 shows a mermaid tail 20. The mermaid tail 20 is tubular and features a leg section 52 that surrounds a user's legs, a waist section 48 that holds the tail around a user's waist, and a tail section 50 that fits around swimming device 10, not shown in FIG. 5. Waist section 48 fits around a user's waist to hold mermaid tail 20 in an appropriate place. Waist section 48 can include other features, such as tacky rubber, to decrease the risk of the mermaid tail 20 sliding on the user. Leg section 52 is attached to waist section 48. Leg section 52 fits around a user's legs tight enough to hold itself in place. Shown in FIG. 5, mermaid tail 20 includes tail section 50 connected to leg section 52. In a preferred embodiment waist section 48, leg section 52, and tail section 50 are made from a single piece of elastic material. Tail section 50 is preferably large enough to extend over a swimming device 10. Extending tail section 50 over swimming device 10 allows the mermaid tail 20 to have a continuous appearance on the user instead of a discontinuous appearance where the swimming device 10 is exposed, creating a joint between the two surfaces.

Figure 6:
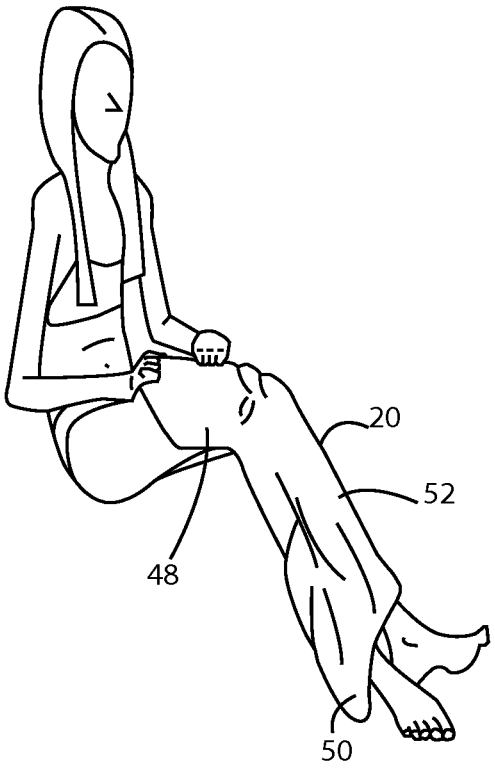
FIG. 6 is a perspective view of a user applying a mermaid tail in accordance with an embodiment of the inventive concepts.
Figure 7:
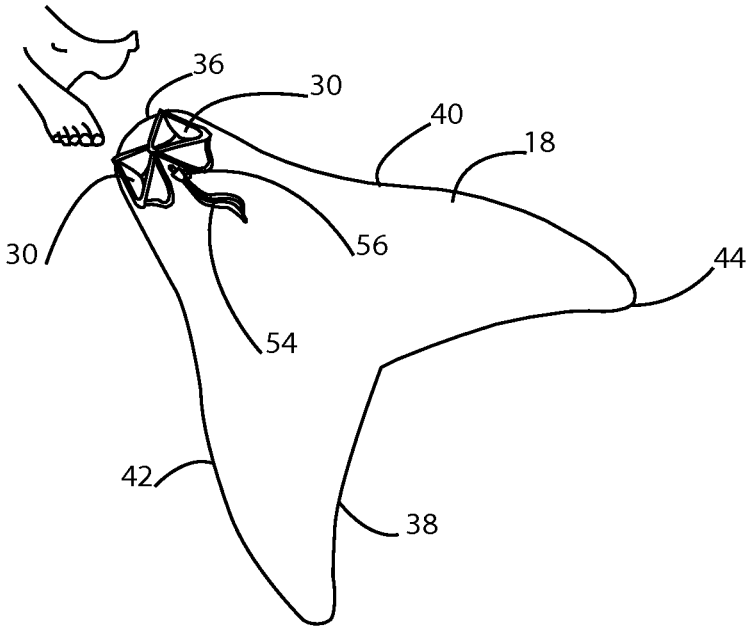
FIG. 7 is a perspective view of a user applying a monofin after applying a mermaid tail in accordance with an embodiment of the inventive concepts.
Figure 8:
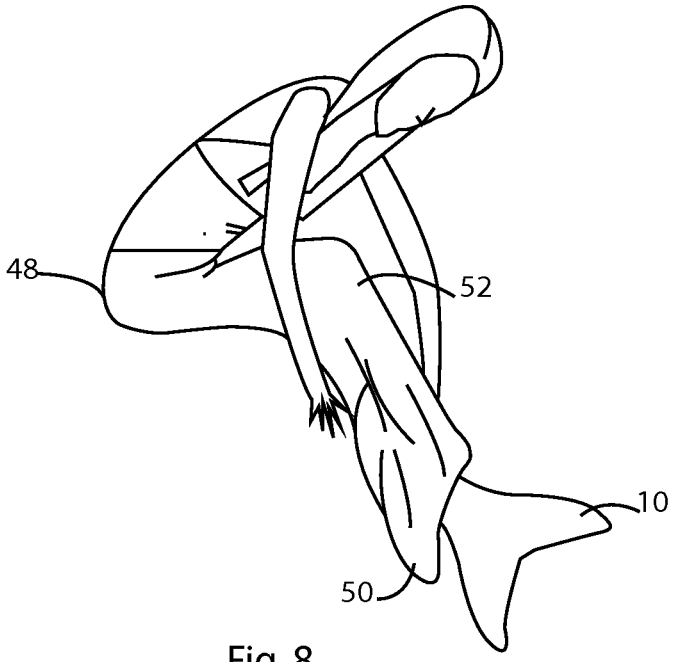
FIG. 8 is a perspective view of a user pulling a tail section of a mermaid tail over a monofin in accordance with an embodiment of the inventive concepts.
Figure 9:
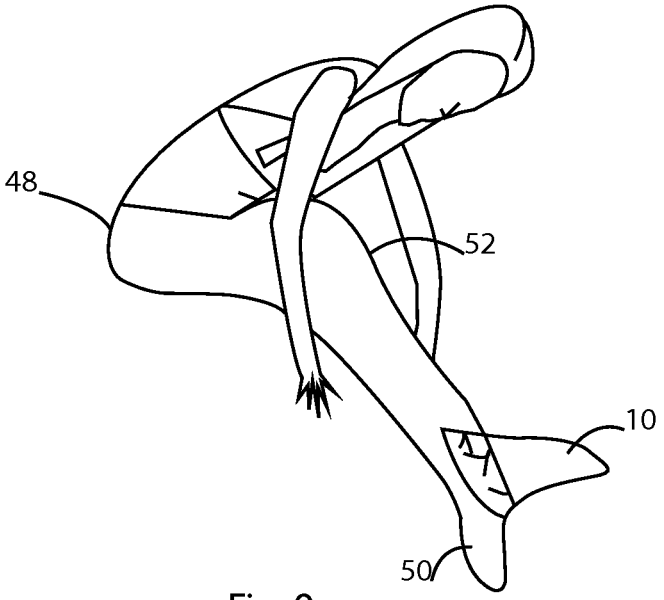
FIG. 9 is a perspective view of a user pulling a tail section of a mermaid tail over a monofin in accordance with an embodiment of the inventive concepts.
Figure 10:
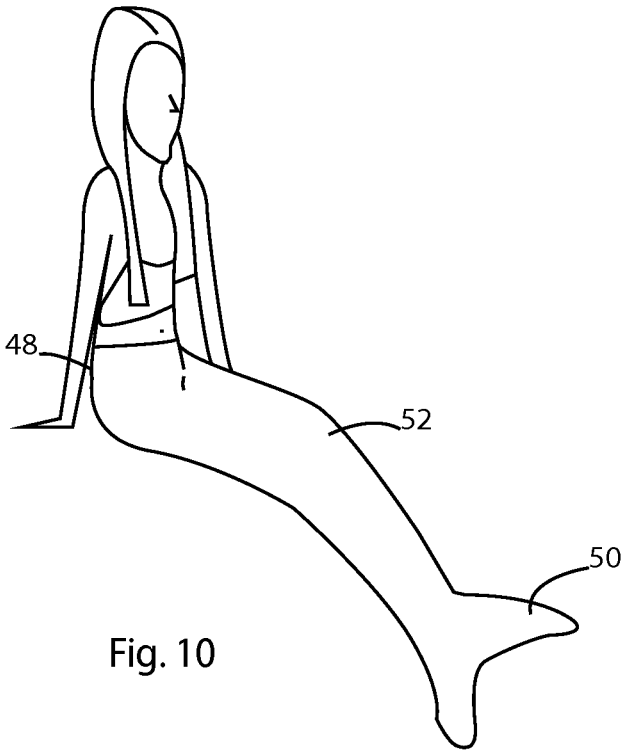
FIG. 10 is a perspective view of a user having applied a mermaid tail in accordance with an embodiment of the method.

Also disclosed is a method of applying a mermaid tail 20 to create the appearance that the user is a mermaid. FIG. 6 shows step one of the method, placing the mermaid tail around both legs of a user. In a preferred embodiment this is done by sliding the waist section 48 over a users feet and further sliding the leg section 52 and tail section 50 over the user's feet. As one alternative, the mermaid tail 20 can be rolled over a user's legs if the mermaid tail 20 is previously rolled. Step two, also shown in FIG. 6, is pulling the waist section 48 at a user's waist. Preferably this is done by sliding waist section 48 until waist section 48 is correctly placed. While sliding waist section 48, the leg section 52 extends to cover a user's legs. Step three, shown in FIG. 7, is to expose the user's feet through the tail section 50. This allows a user to complete step four which is attaching swimming device 10 to the user's feet. While different designs of swimming device 10 are possible, in a preferred embodiment swimming device 10 has individual foot retainers 30 for each of a user's feet and extends away from the user's feet in a mermaid tail fin shape. Step five, shown in FIGS. 8 and 9, is pulling tail section 50 over the swimming device 10 and securing it in place. Upon pulling tail section 50 over the swimming device 10, and the waist section 48 remains at the user's waist, the user appears to have a mermaid tail and is capable of swimming in a fashion similar to a mermaid, as shown in FIG. 10.

While certain exemplary embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

We claim:

1. A swimming device, comprising:

a resilient member being flat and elongate and having a first side, a second side, a third side, and a fourth side;

a cover which substantially surrounds said resilient member, said cover having a periphery comprising a first edge, a second edge, a third edge, and a fourth edge;

at least one foot retainer capable of receiving and retaining one or both of a user's feet, said at least one foot retainer attached to or formed by said cover and located near said first edge of said cover on a top side of said swimming device, so that said resilient member extends under and beyond a user's feet; and at least one securing cord extending through said resilient member and said cover, and located adjacent to said at least one foot retainer.

2. The swimming device of claim 1 in which said foot retainer comprises a left and a right foot retainer, with said securing cord positioned between said left and right foot retainer.

3. The swimming device of claim 1 in which said foot retainer comprises a left and a right foot retainer, with a securing cord positioned outside said left or right foot retainer.

4. The swimming device of claim 1 wherein said first side of said resilient member is at least the width of a user's feet, and said second side of said resilient member is wider than said first side of said resilient member.

5. The swimming device of claim 1 wherein said second side of said resilient member is between 1 and 6 times the length of said first side of said resilient member.

6. The swimming device of claim 5 wherein said second side of said resilient member forms a concave arc.

7. The swimming device of claim 5 wherein said resilient member is in the shape of a fish tail.

8. The swimming device of claim 1 wherein said cover is releasably affixed to said resilient member.

9. The swimming device of claim 5 wherein said cover comprises a top half and a bottom half that are permanently affixed to said resilient member by stitching connecting the periphery of said top half and said bottom half.

10. The swimming device of claim 7 wherein said resilient member is made of plastic.

11. The swimming device of claim 7 wherein said cover is made of neoprene.

12. The swimming device of claim 1 wherein said cover comprises a top half and a bottom half that are secured around said resilient member, said cover further comprising a rear side positioned adjacent to said first side of said resilient member, said rear side having a height configured to enclose a user's heel.

13. The swimming device of claim 1 further comprising:

a mermaid tail configured to slide over a user's feet;

said mermaid tail having a leg section, a waist section, and a tail section;

said leg section being generally tubular and attached to said waist section so that a user's feet can pass through said waist section and through said leg section;

said tail section attached to said leg section so that a user's feet can pass through said leg section and into said tail section;

said tail section configured to extend over said resilient member and said cover when said swimming device is attached to a user's feet.

14. The swimming device of claim 13 wherein said mermaid tail is comprised of a single piece of elastic material.

15. A method of applying a mermaid tail comprising the steps of:

a. placing a mermaid tail around both legs of a user; said mermaid tail comprising a leg section configured to fit around a user's legs, a waist section attached to said leg section and open to fit around a user's waist, and a tail section attached to said leg section and open to fit around a monofin;

b. placing said waist section of said mermaid tail around a user's waist;

c. exposing a user's feet through the tail section of the mermaid tail;

d. placing a swimming device on the user's feet, wherein said swimming device is a monofin with a foot retainer and a securing cord for more securely keeping a user's foot in said foot retainer; and e. pulling said tail section of said mermaid tail over said swimming device.

16. The method of claim 15 wherein step (a) comprises sliding said mermaid tail around both legs wherein said mermaid tail is formed of a single piece of material.

17. A swimming device, comprising:

a resilient member having a first side, a second side, a third side, and a fourth side;

a cover having a first edge, a second edge, a third edge, and a fourth edge corresponding respectively to the first side, second side, third side, and fourth side of the resilient member, said cover covering at least a portion of the first side, second side, third side, and fourth side of the resilient member; and at least one foot retainer attached to or formed by the cover and capable of receiving a user's foot, said foot retainer located near the first edge of the cover so that the resilient member extends under and beyond a user's foot.

18. The swimming device of claim 17 wherein the cover has a top half and a bottom half that respectively cover at least a portion of a top half of the resilient member and at least a portion of a bottom half of the resilient member.

19. The swimming device of claim 18 wherein the cover is releasably affixed to the resilient member.

20. The swimming device of claim 19 wherein the second side of the resilient member is wider than the first side.

21. The swimming device of claim 20 wherein the first side of the resilient member is wider than both of a user's feet.

22. The swimming device of claim 21 wherein the resilient member is in the shape of a fish tail.

23. The swimming device of claim 22 wherein the cover further comprises a rear side positioned adjacent to the first side of the resilient member, said rear side having a height configured to enclose a user's heel.

24. The swimming device of claim 22 wherein the resilient member is a monofin.

25. The swimming device of claim 22 wherein the resilient member is made of plastic.

26. The swimming device of claim 22 wherein the cover is made of neoprene.

27. The swimming device of claim 22 wherein each foot retainer includes a hole formed in the cover for receiving a user's foot.

28. The swimming device of claim 22 wherein each foot retainer includes a sock structure for receiving a user's foot.

29. The swimming device of claim 17 further comprising one or more cords for securing the cover to the resilient member.

30. The swimming device of claim 29 wherein a cord for securing the cover to the resilient member is positioned between a first foot retainer and a second foot retainer.

31. The swimming device of claim 29 wherein a cord for securing the cover to the resilient member is positioned outside a first foot retainer and a second foot retainer.

32. The swimming device of claim 29 wherein a cord for securing the cover to the resilient member is positioned inside a first foot retainer and a second foot retainer, and another cord for securing the cover to the resilient member is positioned outside the first foot retainer and the second foot retainer.

33. The swimming device of claim 18 further comprising:

a mermaid tail configured to slide over a user's feet;

the mermaid tail having a leg section, a waist section, and a tail section;

the leg section being generally tubular and attached to the waist section so that a user's feet can pass through the waist section and through the leg section; and the tail section attached to the leg section so that a user's feet can pass through the leg section and into the tail section.

34. The swimming device of claim 33 wherein the tail section is configured to extend over the resilient member.

35. The swimming device of claim 34 wherein the tail section has an open configuration so that a user's feet can extend through the tail section and so the tail section can be wrapped over the resilient member.

36. The swimming device of claim 34 wherein the cover is releasably affixed to the resilient member.

37. The swimming device of claim 36 wherein the second side of the resilient member is wider than the first side.

38. The swimming device of claim 37 wherein the first side of the resilient member is wider than both of a user's feet.

39. The swimming device of claim 38 wherein the resilient member is in the shape of a fish tail.

40. The swimming device of claim 39 wherein the cover further comprises a rear side positioned adjacent to the first side of the resilient member, said rear side having a height configured to enclose a user's heel.

41. The swimming device of claim 39 wherein the resilient member is a monofin.

42. The swimming device of claim 39 wherein the resilient member is made of plastic.

43. The swimming device of claim 39 wherein the cover is made of neoprene.

44. The swimming device of claim 39 wherein each foot retainer includes a hole formed in the cover for receiving a user's foot.

45. The swimming device of claim 39 wherein each foot retainer includes a sock structure for receiving a user's foot.

46. The swimming device of claim 33 further comprising one or more cords for securing the cover to the resilient member.

47. The swimming device of claim 46 wherein a cord for securing the cover to the resilient member is positioned between a first foot retainer and a second foot retainer.

48. The swimming device of claim 46 wherein a cord for securing the cover to the resilient member is positioned outside a first foot retainer and a second foot retainer.

49. The swimming device of claim 46 wherein a cord for securing the cover to the resilient member is positioned inside a first foot retainer and a second foot retainer, and another cord for securing the cover to the resilient member is positioned outside the first foot retainer and the second foot retainer.

50. The swimming device of claim 1 wherein each foot retainer includes a hole formed in the cover for receiving a user's foot.

51. The swimming device of claim 1 wherein each foot retainer includes a sock structure for receiving a user's foot.

52. A swimming device, comprising:

a resilient member being flat and elongate, and having a first side, a second side, a third side, and a fourth side;

a cover configured to cover said resilient member, said cover having a periphery comprising a first edge, a second edge, a third edge, and a fourth edge; and at least one foot retainer capable of receiving and retaining both of a user's feet, said at least one foot retainer attached to or formed by said cover;

said at least one foot retainer located near said first edge of said cover so that said resilient member extends under and beyond a user's feet.

53. The swimming device of claim 52 wherein the cover is releasably affixed to the resilient member.

54. The swimming device of claim 53 wherein the first side of the resilient member is wider than both of a user's feet.

55. The swimming device of claim 54 wherein the resilient member is in the shape of a fish tail.

56. The swimming device of claim 55 wherein the cover further comprises a rear side positioned adjacent to the first side of the resilient member, said rear side having a height configured to enclose a user's heel.

57. The swimming device of claim 55 wherein the resilient member is a monofin.

58. The swimming device of claim 52 wherein each foot retainer includes a hole formed in the cover for receiving a user's foot.

59. The swimming device of claim 52 wherein each foot retainer includes a sock structure for receiving a user's foot.

60. The swimming device of claim 55 further comprising one or more cords for securing the cover to the resilient member.

61. The swimming device of claim 60 wherein a cord for securing the cover to the resilient member is positioned between a first foot retainer and a second foot retainer.

62. The swimming device of claim 60 wherein a cord for securing the cover to the resilient member is positioned outside a first foot retainer and a second foot retainer.

63. The swimming device of claim 60 wherein a cord for securing the cover to the resilient member is positioned inside a first foot retainer and a second foot retainer, and another cord for securing the cover to the resilient member is positioned outside the first foot retainer and the second foot retainer.

64. The swimming device of claim 52 further comprising:

a mermaid tail configured to slide over a user's feet;

the mermaid tail having a leg section, a waist section, and a tail section;

the leg section being generally tubular and attached to the waist section so that a user's feet can pass through the waist section and through the leg section; and the tail section attached to the leg section so that a user's feet can pass through the leg section and into the tail section.

65. The swimming device of claim 64 wherein the tail section is configured to extend over the resilient member.

66. The swimming device of claim 65 wherein the tail section has an open configuration so that a user's feet can extend through the tail section and so the tail section can be wrapped over the resilient member.

67. The swimming device of claim 65 wherein the cover is releasably affixed to the resilient member.

68. The swimming device of claim 67 wherein the second side of the resilient member is wider than the first side.

69. The swimming device of claim 68 wherein the first side of the resilient member is wider than both of a user's feet.

70. The swimming device of claim 69 wherein the resilient member is in the shape of a fish tail.

71. The swimming device of claim 70 wherein the cover further comprises a rear side positioned adjacent to the first side of the resilient member, said rear side having a height configured to enclose a user's heel.

72. The swimming device of claim 70 wherein the resilient member is a monofin.

73. The swimming device of claim 70 wherein the resilient member is made of plastic.

74. The swimming device of claim 70 wherein the cover is made of neoprene.

75. The swimming device of claim 70 wherein each foot retainer includes a hole formed in the cover for receiving a user's foot.

76. The swimming device of claim 70 wherein each foot retainer includes a sock structure for receiving a user's foot.

* * * * *